United States Patent [19]

Schmideler

[11] 4,085,289

[45] Apr. 18, 1978

[54] LOUDSPEAKER SYSTEM

[76] Inventor: Jeffrey B. Schmideler, 2978 No. 54th St., Milwaukee, Wis. 53210

[21] Appl. No.: 733,330

[22] Filed: Oct. 18, 1976

[51] Int. Cl.[2] ..... H04R 1/28; H04R 1/34

[52] U.S. Cl. ..... 179/1 VE; 181/153

[58] Field of Search ..... 179/1 VE, 1 E, 1 AT; 181/154, 155, 175, 191, 199, 148, 153; 224/42.42 R, 42.45 R, 29 D; 325/312, 313, 314

[56] References Cited

U.S. PATENT DOCUMENTS

| | | | |
|---|---|---|---|
| 3,291,353 | 12/1966 | Sobczak | 224/42.42 A |
| 3,393,766 | 7/1968 | Mitchell | 179/1 E |
| 3,870,210 | 3/1975 | Trammell | 224/42.45 R |
| 3,882,962 | 5/1975 | Ripple | 181/154 |

FOREIGN PATENT DOCUMENTS

| | | | |
|---|---|---|---|
| 2,433,916 | 1/1976 | Germany | 181/155 |
| 1,404,316 | 8/1975 | United Kingdom | 179/1 VE |

OTHER PUBLICATIONS

A. R. Bailey, "The Transmission Line Loudspeaker Enclosure," Wireless World, May 1972, vol. 78, No. 1439, pp. 215-217.

*Primary Examiner*—Kathleen H. Claffy
*Assistant Examiner*—Kenneth A. Chayt
*Attorney, Agent, or Firm*—Andrus, Sceales, Starke & Sawall

[57] ABSTRACT

In the passenger compartment of an automobile or the like, a forwardly facing generally bucket-shaped loudspeaker enclosure is essentially sealed to the exposed lower corner or edge of the dashboard, and a rearwardly facing sound reflector is mounted under the dashboard and spaced from the speaker enclosure. The speaker is mounted within the enlarged end of the enclosure, the latter having an insulating lining.

4 Claims, 9 Drawing Figures

LOUDSPEAKER SYSTEM

BACKGROUND AND SUMMARY OF THE INVENTION

This invention relates to a loudspeaker system for use in such places as the passenger compartment of an automobile or the like.

In present day car stereo systems, the rear channel speaker system is usually placed in the rear deck, while the front channel system is usually disposed in the front doors or adjacent kick panels.

The arrangement of the front speaker system is of utmost importance because front passengers occupy a car much more frequently than rear passengers and the quality of sound distribution by the front speaker system is thus more noticeable. Door and kick panel mounting of spekeers is not believed to provide truly high quality sound, at least partially because the speakers must be quite small due to space limitations.

It has been suggested that a front speaker system be positioned under the front seat with a forwardly directed and upwardly inclined speaker cone. See U.S. Pat. No. 3,882,962 issued on May 13, 1975 to Warren Ripple. Although a relatively large loudspeaker may be incorporated in such a system to provide deeper bass sounds, the effect is still very directional.

One aspect of the present invention is based on the concept of providing a forwardly facing speaker enclosure which is essentially sealed to the exposed lower corner or edge of the dashboard, together with a rearwardly facing sound reflector mounted under the dashboard and spaced from the speaker enclosure. In another aspect of the invention, the loudspeaker is mounted within the enlarged end of a conical generally bucket-shaped housing, the latter having an insulating lining.

BRIEF DESCRIPTION OF THE DRAWINGS

The accompanying drawings furnished herewith illustrate the best mode presently contemplated by the inventor for carrying out the invention.

In the drawings.

DESCRIPTION OF THE PREFERRED EMBODIMENT

Figure 1:
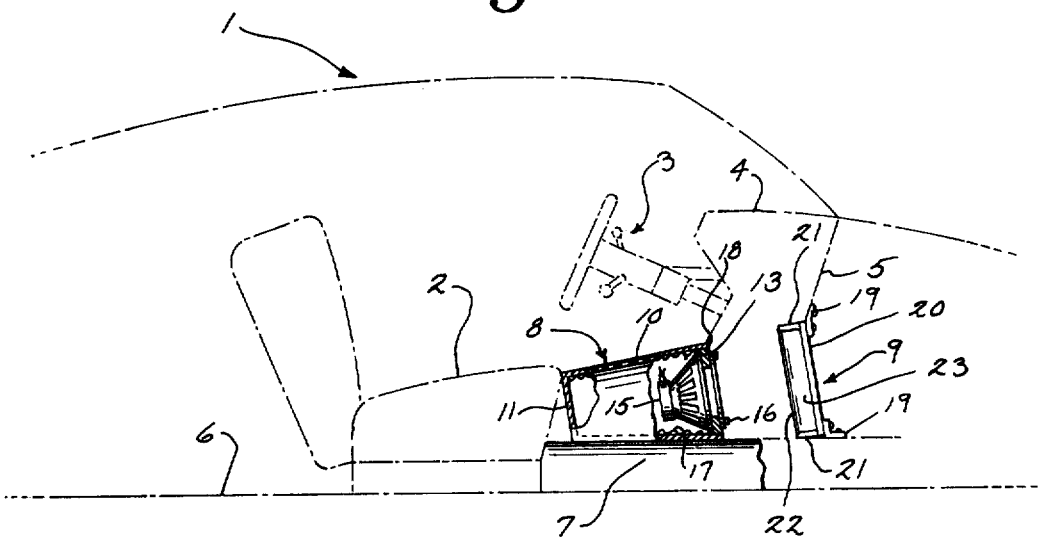
FIG. 1 is a schematic side elevation of an automobile passenger compartment and showing the speaker system installed therein, with parts broken away and in section.
Figure 2:
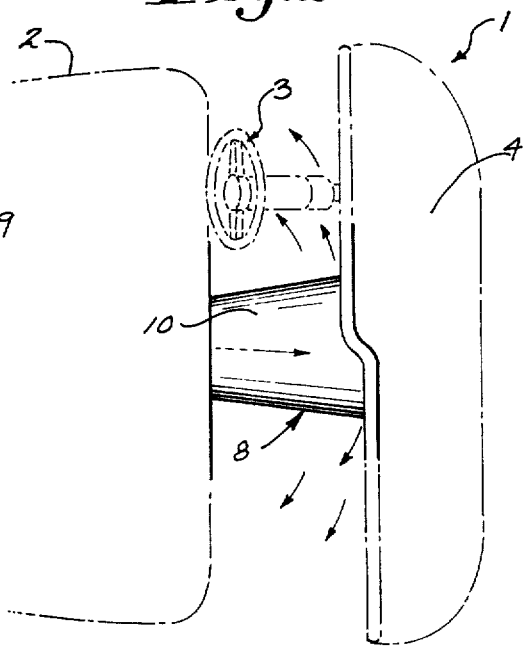
FIG. 2 is a schematic top plan view of the said compartment and system.

As best shown in FIGS. 1 and 2, the loudspeaker system of the invention is adapted to be installed in the front passenger compartment of an automobile 1 having a front seat 2, a steering wheel and column 3, a rearwardly extending dashboard 4, a forward firewall 5, and in this instance a floor 6 having a transmission tunnel 7.

The invention contemplates utilization of a sound transmitting amplifier of the usual well-known type, not shown, and a speaker system including an elongated forwardly facing annular speaker enclosure 8 and a sound reflector 9.

Figure 6:
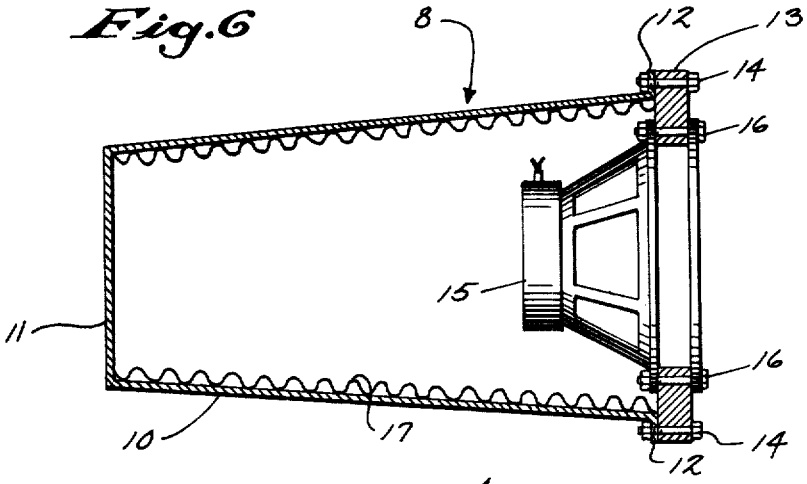
FIG. 6 is an enlarged vertical section of the speaker enclosure of FIG. 1.

Referring primarily to FIGS. 1 and 6, enclosure 8 is in the form of a bucket having a conical side wall 10 and an integral circular inner end closure wall 11. The enlarged outer or forward open end of enclosure 8 forms a flange 12 to which is secured an annular ring 13, as by bolts 14. A loudspeaker 15 of any suitable well-known type is coaxially disposed within enclosure 8, faces forwardly through the open end thereof and is secured to ring 13 as by bolts 16.

Enclosure 8 is preferably formed from polyethylene or other similar plastic material and may comprise a bucket of the type available at many retail stores. Such buckets are thin-walled, 1/16 - 1/32 inch thickness being desirable. The thin plastic bucket walls 10 and 11 are slightly flexible and form a large resonating surface area to the rear of speaker 15.

Insulation 17 may cover the inner surface of the bucket.

It is contemplated that enclosure 8 preferably be installed centrally of the vehicle, such as by resting on transmission tunnel portion 7 of floor 6. The enclosure is contemplated as being held in place by tightly confining its ends between the front face of seat 2 and the exposed lower corner 18 of dashboard 4. This is accomplished by placing enclosure 8 on floor 6 when seat 2 is in its rearward position, and then adjusting the seat forwardly until the enclosure sealingly engages corner 18. By securing the entire speaker assembly in this fashion, the entire assembly may be easily removed and the speaker played even when the assembly is outside the vehicle, assuming a sufficiently long wire connection to the amplifier.

Figure 5:
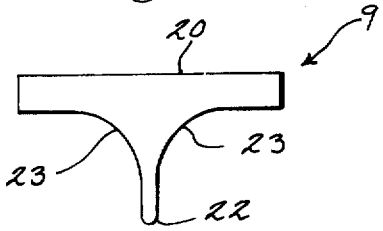
FIG. 5 is a top plan view of the reflector.
Figure 3:
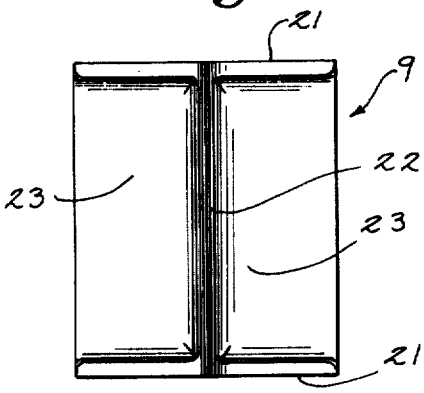
FIG. 3 is an enlarged front elevation of the sound reflector.
Figure 4:
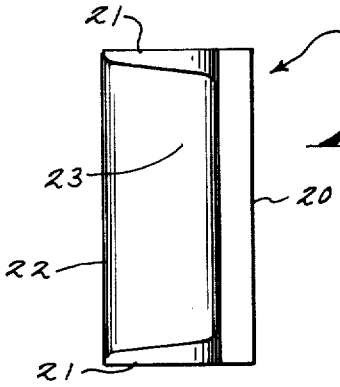
FIG. 4 is a side elevation of the reflector.

In accordance with one aspect of the invention, sound radiated forwardly by loudspeaker 15 and past the seal at corner 18 is reflected rearwardly and to the sides. For this purpose, a hard surfaced sound reflector panel 9 is positioned forwardly from the front terminus of enclosure 8, and is spaced therefrom. As shown in FIG. 1, reflector panel 9 is secured to tunnel 7 and fire wall 5 as by brackets 19 and is located directly in the path of the sound emanating from speaker 15. Referring to FIGS. 3–5, relector panel 9 comprises a generally upright planular base 20 having top and bottom flanges 21 and which merges into a rearwardly extending generally vertical central rib 22. The base and rib together form a pair of sound reflective surfaces 23 which curve gradually from transverse to the speaker axis to parallel thereto. Surfaces 23 cause the forwardly moving sound waves to disperse and be reflected rearwardly and to the sides of the passanger compartment and also, to a certain extent, upwardly into the dash cavity forwardly of the seal at corner 18. The result is a generally non-directional sound having clear, well dispersed high and low frequency distribution. It has been found that no additional speakers are necessary in the front of the compartment.

Figure 7:
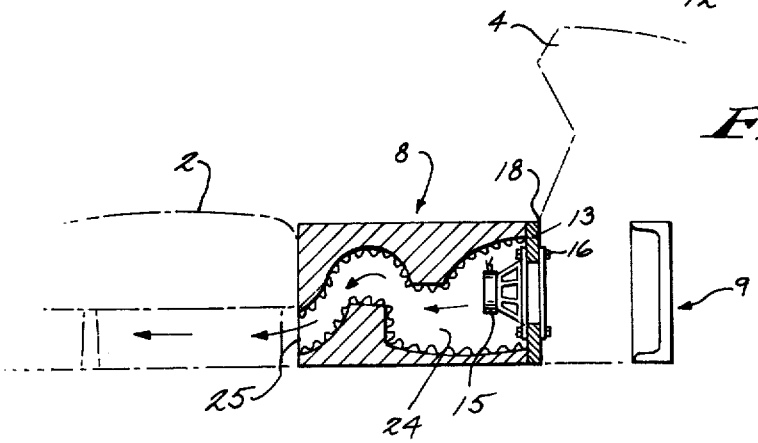
FIG. 7 is a schematic side elevation showing a different embodiment of the speaker system.

In some instances, it may be desirable to enhance the sound from the rear speakers, not shown, with the sound from front speaker 15, especially for those passengers seated in the back. For this purpose, and as shown in FIG. 7, enclosure 8, instead of being essentially hollow, is relatively solid and is provided with a tortuous channel 24 which extends from speaker 15 and rearwardly to a port 25 disposed at the rear of the assembly and below seat 2 for discharge of sound to the rear beneath the seat.

Figure 8:
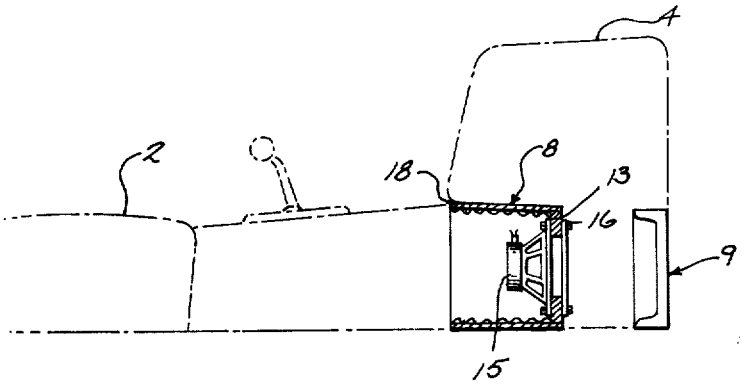
FIG. 8 is a schematic side elevation showing yet another embodiment of the speaker system.

In another embodiment shown in FIG. 8, the entire speaker enclosure 8 is mounted beneath dashboard 4 and is spaced rearwardly from sound reflective panel 9.

Figure 9:
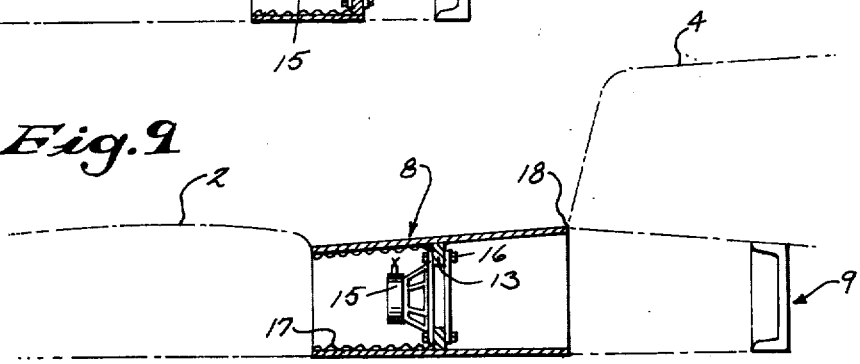
FIG. 9 is a schematic side elevation of a further embodiment of the speaker system.

In yet another embodiment, shown in FIG. 9, the speaker 15 is disposed midway between the ends of enclosure wall 10.

Each of the embodiments provides a different type of sound quality.

In all embodiments, the speaker enclosure firmly engages the dash so that a substantial portion of the sound reaches panel 9 for reflection in the desired manner.

The concepts of the invention provide a unique improvement in the distribution of sound in the passenger compartment of a vehicle. It is relatively inexpensive to manufacture, and installation costs should be at a minimum because door and kick panels are not involved.

Various modes of carrying out the invention are contemplated as being within the scope of the following claims particularly pointing out and distinctly claiming the subject matter which is regarded as the invention.

I claim:

1. In the passenger compartment of a vehicle having a floor, a front seat, a firewall, and a dashboard extending rearwardly from the firewall and forming a dash cavity and having an exposed lower corner, the combination comprising:

(a) an elongated flexible plastic generally bucket-shaped speaker enclosure having front and rear end portions, (b) said enclosure being disposed in tight confinement between said seat and the said exposed lower corner of said dashboard and with the said front end portion of said enclosure sealingly engaging said lower corner, (c) and a speaker disposed in said enclosure and co-axial therewith and with said speaker facing forwardly to radiate sound from said contained enclosure past the said portion of sealing engagement and beneath said dashboard.

2. The passenger compartment of claim 1 which includes sound reflective means disposed beneath said dashboard and between said front end of said enclosure and said firewall for reflecting sound impinging thereon from said speaker rearwardly and to each side of the compartment and upwardly into the dash cavity forwardly of said portion of sealing engagement.

3. The passenger compartment of claim 2 wherein said sound reflective means is secured to said firewall and comprises:

(a) a generally upright planular base which merges into a rearwardly extending vertical central rib, (b) the construction forming a pair of sound reflective surfaces which curve gradually from transverse to the axis of said speaker to parallel thereto.

4. In the passenger compartment of a vehicle having a floor, a front seat, a firewall, and a dashboard extending rearwardly from the firewall and forming a dash cavity and having an exposed lower corner, the combination comprising:

(a) an elongated flexible plastic generally bucket-shaped speaker enclosure having front and rear end portions, (b) said enclosure being disposed in firm engagement with said dashboard, (c) a speaker disposed in said enclosure and co-axial therewith and with said speaker facing forwardly to radiate sound beneath said dashboard, (d) and sound reflective means disposed beneath said dashboard and between said front end of said enclosure and said firewall for reflecting sound impinging thereon from said speaker rearwardly and to each side of the compartment and upwardly into the dash cavity.

* * * * *